United States Patent [19]

Hochschild, III

[11] Patent Number: 4,905,331

[45] Date of Patent: Mar. 6, 1990

[54] WATERMATTRESS

[76] Inventor: Arthur A. Hochschild, III, 5531 Engineer Dr., Huntington Beach, Calif. 92649

[21] Appl. No.: 394,869

[22] Filed: Aug. 17, 1989

[51] Int. Cl.[4] ..... A47C 27/08

[52] U.S. Cl. ..... 5/450; 5/451

[58] Field of Search ..... 5/451, 450, 452, 422, 5/481, 441

[56] References Cited

U.S. PATENT DOCUMENTS

| | | | |
|---|---|---|---|
| 4,301,560 | 11/1981 | Fraige | 5/450 |
| 4,328,599 | 5/1982 | Mollura | 5/451 |
| 4,330,893 | 5/1982 | Matsui | 5/451 |
| 4,332,043 | 6/1982 | Larson | 5/451 |
| 4,532,662 | 8/1985 | Sama | 5/450 |
| 4,751,756 | 6/1988 | Monzo | 5/450 |

*Primary Examiner*—Alexander Grosz

*Attorney, Agent, or Firm*—Georges A. Maxwell

[57] ABSTRACT

An improved waterbed structure including an upwardly opening frame with a horizontal watermattress supporting platform and vertical longitudinally and laterally extending upwardly projecting side and end retaining boards about the perimeter of the platform, a waterfilled watermattress of soft flexible sheet plastic material with a bottom wall supported atop the platform, side and end walls supported by the side and end boards and a normally substantially flat horizontal user supporting top wall. The watermattress includes a multiplicity of longitudinally and laterally spaced elongate vertically extending and downwardly tapering support spring parts of soft resilient interconnected cellular material in load supporting relationship between the top and bottom walls. The support spring parts are shaped springs that afford progressively greater vertical load supporting force as they are compressed and are positioned within those portions of the watermattress where supplemental vertical load carrying capacity is advantageously afforded. Water within the parts controls their spring rate as it is expressed from and drawn into those parts upon compression and relaxation thereof. The downwardly tapered parts work to notably impede lateral movement of water and absorb wave motion energy within the upper portion of the watermattress while affording no appreciable resistance to the free movement and distribution of water throughout the lower portion thereof.

16 Claims, 4 Drawing Sheets

WATERMATTRESS

This invention has to do with a waterbed structure and is more particularly concerned with a new and improved

BACKGROUND OF THE INVENTION

The most common waterbed structure in use today is characterized by a bladder-like watermattress of soft flexible sheet plastic defining substantially flat horizontal top and bottom walls and vertical side and end walls. The watermattress is engaged in a frame structure with a horizontal platform and vertical side and end retaining boards that support and retain the bottom, side and end walls of the mattress. The mattress is filled with a sufficient volume of water so that it substantially fully occupies the space defined by the frame yet leaves the top wall sufficient slack so that it will yield and conform to the bodies of persons engaged and supported atop it to an extent that the bodies are buoyantly supported by the water therein, with the top wall of the mattress as a barrier therebetween.

In practice, ordinary watermattresses are close to 7' long and are 4 or more feet wide, while being only about 8" in vertical extent or depth.

In most waterbed structures the depth of the watermattresses, together with the slack that is afforded to the top walls thereof is such that the top walls are subject to bottoming out, that is, being displaced downwardly into stopped engagement with the bottom walls when excessive weight is concentrated at small areas of the top walls. The foregoing is subject to creating serious adverse effects.

In addition to the foregoing, when persons seek to position themselves atop waterbed mattresses and when they seek to move from position atop thereof, they shift and move their bodies to sitting positions at a side of the bed structure with their legs extended over and outward of an adjacent retaining board and with their "bottoms" engaged stop small areas at the sides of the top walls of the watermattresses. In such instances, the weight of the persons displace the mattresses downwardly to an extent that in order to extract themselves from within the mattresses becomes extremely difficult and burdensome. The foregoing is a major reason why many people find waterbeds undesirable.

In addition to the foregoing, for comfortable and effective rest when a person lies down, on his back, atop a watermattress it is important that the lower lumbar region of his back be held up and supported to a substantial extent in order to prevent serious adverse stressing and fatigue that can lead to great discomfort and other serious adverse effects. In the case of ordinary watermattresses, those portions of the mattresses that support the lower lumbar regions of the backs of users afford no more vertical support than any other regions or areas of the mattresses and tend to allow the heavy lower lumbar regions of the backs of the users to sink more deeply in the mattress, overstressing their lower backs and causing serious adverse effects. The foregoing adverse effects are most frequently experienced by elderly and middle-aged persons and by those persons who are less physically fit than those young physically fit persons who are now the principal users of waterbeds and find them to be satisfactory.

Finally in watermattresses of the general character referred to above, when persons engage their bodies thereon and when they move atop those mattresses they generate wave motion in the mattresses. The initial energy of such wave motion is often substantial and diminishes rather slowly as the waves move back and forth in the mattresses, rebounding from side to side thereof. Such wave action is, for many people, extremely disturbing and is the major objection that is expressed by those persons who find waterbeds unsatisfactory.

As a result of the above-noted shortcomings and objections to waterbeds, those who design, manufacture and sell waterbeds have, for many years, sought to eliminate or notably reduce wave motion in such mattresses and have sought to impart certain areas of such mattresses with greater vertical support than is supported in other areas thereof. To the above end, the marketplace is now proliferated with watermattresses with many different forms of baffle structures that are intended to eliminate wave motion, mattresses that are filled with various kinds and/or combinations of fibrous and foam-like materials intended to stop or reduce wave motion and/or to impart desired increased support in certain areas thereof. Other watermattresses that are found in the marketplace are sectional or cellular structures, while still other mattresses are what might be called hybrid mattress structures in which selected features of watermattresses and common mattresses are combined in an effort to overcome those features and characteristics of watermattresses that many people find objectionable.

In the case of each of the above-referred to enhanced watermattresses, claims are made that they eliminate and/or reduce one or more of the shortcomings that I have noted in the foregoing. While all of the above noted enhanced watermattresses provided by the prior art can be said to afford some desired and/or beneficial end results, the magnitude of those results is often minor. In those few instances where one shortcoming found to exist in common unenhanced watermattresses have been notably reduced to eliminated, some desirable aspect or feature of the watermattress is found to have been compromised to some notable extent.

In accordance with the foregoing, there still exists the need for new, improved and better watermattresses and the prior art has clearly left notable room for major improvements to be made.

OBJECTIVES AND FEATURES OF MY INVENTION

It is an object of my invention to provide a new interior support structure for watermattresses that operates to notably enhance the vertical support afforded by the mattresses in those areas of the mattresses where increased support is desired.

Another object of the invention is to provide a new interior support structure for watermattresses that effectively and quickly reduces wave motion in its related watermattress to a negligible extent by more effectively and efficiently managing the movement of the water and the decay of wave motion energy within the watermattress.

It is an object and feature of the invention to provide an interior support structure for watermattresses for the purposes noted above that includes a multiplicity of spaced-apart vertically extending, resilient, hydraulically dampered support springs arranged in the areas of the watermattress where added vertical support is to be afforded and that normally afford yielding vertical support between the top and bottom walls of the watermattress.

Yet another object and feature of the invention is to provide an interior support structure for watermattresses of the general character referred to above wherein the spaced-apart resilient vertically extending spring support parts are downwardly convergent pyramidal or conical parts made of interconnected cellular foam material the surface area of which decreases at a rate that is substantially equal to or slightly greater than the average rate at which wave motion energy, within the watermattress, decreases downwardly so that the support spring parts afford greater wave motion energy absorbing surface area where wave motion and wave motion energy within the watermattresses is greater than where that motion and energy is least and so that they afford negligible resistance to the movement of water throughout the lower portions of the watermattresses and allow for substantial free displacement of water in and throughout the entire horizontal planes of the watermattresses.

It is an object and feature of the invention to provide a structure of the general character referred to above wherein the resilient interconnected cellular support spring parts of my new interior support structure are vertically compressible and are shaped springs that become progressively stronger and afford greater resistance and load supporting capacity as they are compressed.

The spring rate of the interconnected cellular support spring parts of my new interior support structure for watermattresses is substantially equal to the normal rate of rebound of the top wall of the mattress when, after being depressed by a vertical load applied to it, is left to return to its normal position.

The cellular support spring parts of my new interior support structure for watermattresses are permeated with the water in which they are immersed and are such that the water therein hydraulically buffers the action thereof when those parts are compressed and when they are relaxed and allowed to return to their original configuration. The interconnected cellular material of which the support spring parts of my new structure are made is such that water within the cells thereof serves to normally support the cells and the whole of the spring parts in their normal or set positions.

Another object and feature of my invention is to provide a new interior support structure for watermattresses of the general character referred to wherein the related support parts thereof are connected one to the other by a horizontal upper sheet or panel that occurs below the top wall of the watermattress and that normally maintains the support spring parts vertical and in predetermined spaced relationship with each other.

The upper sheet or panel is established of the same material as the support spring parts, extends between and is integrally joined with the upper ends of the parts, about the upper perimeters thereof.

Another object and feature of my invention is to provide an improved watermattress structure of the general character referred to above wherein my new support spring parts are positioned within the watermattress adjacent one or more side portions thereof upon which persons sit and impose their weight when moving on to and off of supported engagement atop the watermattress.

It is an object and feature of my invention to provide a novel and improved watermattress of the general character referred to above wherein my new support spring parts are positioned and arranged to occur between the top and bottom walls of the watermattress beneath that portion of the top wall that is normally engaged by and that supports the lower lumbar region of the backs of persons lying atop the watermattress.

Still another object and feature of my invention is to provide an improved watermattress of the general character referred to above wherein the wave motion dampening support spring parts that I provide are arranged in an H pattern with elongate laterally spaced parallel side portions that occur adjacent and extend parallel with opposite side portions of the watermattress and a laterally extending central portion that is joined with and extends between said side portions and occurs below that portion of the top wall of the watermattress atop which the low lumbar region of users' backs are supported.

Finally, it is object and feature of my invention to provide an improved watermattress structure of the general character referred to above wherein my new interior support and wave motion dampening structure includes an upper horizontal sheet that is substantially coextensive with and occurs below the top wall of the watermattress and wherein said upper sheet is joined with and orients my new support spring parts in and throughout those areas of the watermattress where increased vertical support is sought to be provided. The upper sheet maintains the support spring parts properly positioned and the support spring parts maintain the upper sheet up within the watermattress in substantial uniform stopped engagement with the bottom of the top wall thereof.

The foregoing and other objects and features of my invention will be apparent and will be fully understood from the following detailed description of the invention throughout which description reference is made to the accompanying drawings.

DETAILED DESCRIPTION OF THE INVENTION

Figure 1:
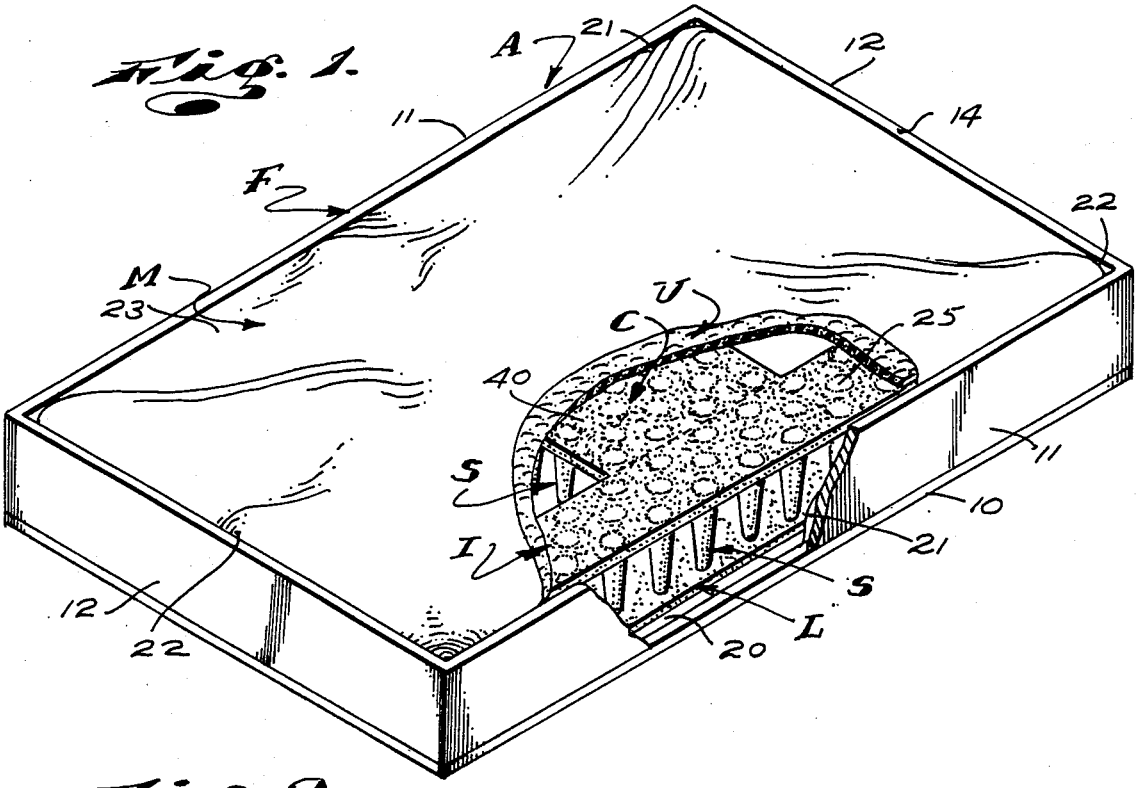
FIG. 1 is an isometric view of a waterbed embodying my invention and with portions broken away to illustrate details thereof.
Figure 2:
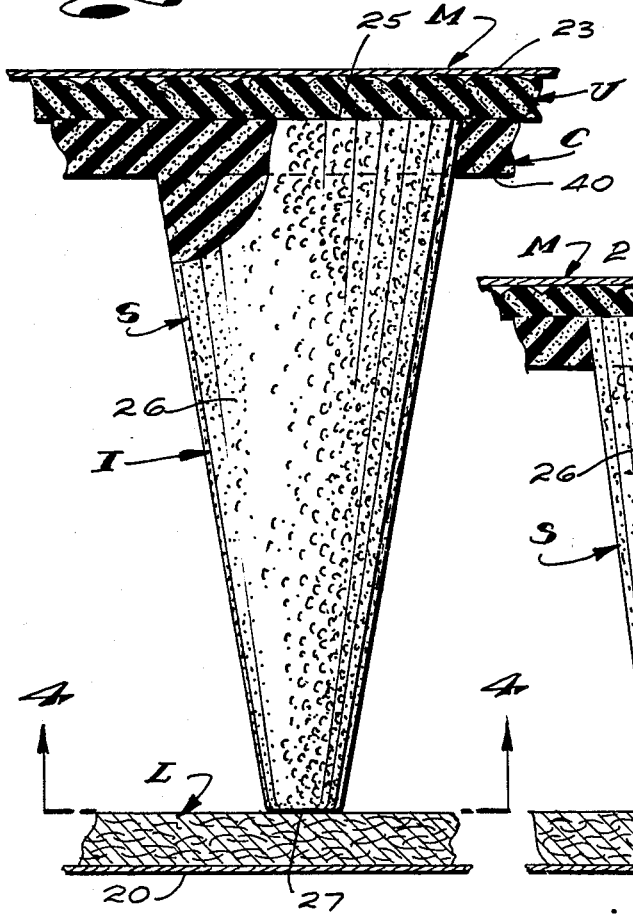
FIG. 2 is a view of a portion of a structure shown in FIG. 1.
Figure 3:
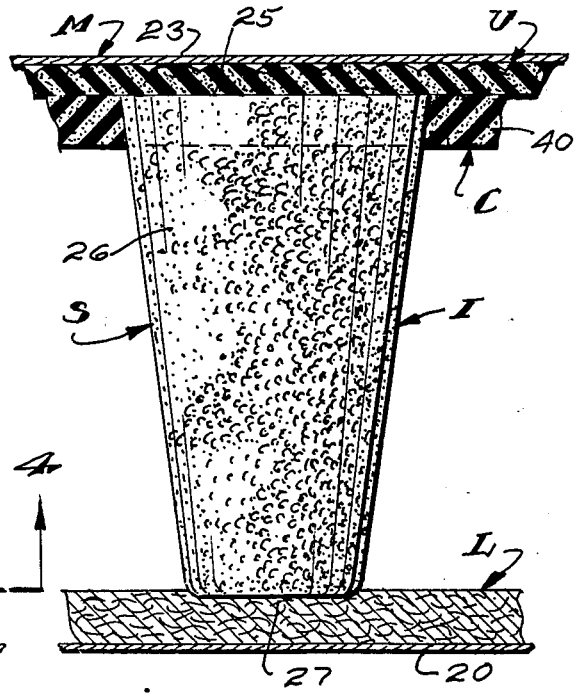
FIG. 3 is a view of the structure shown in FIG. 2 with parts in different positions.
Figure 4:
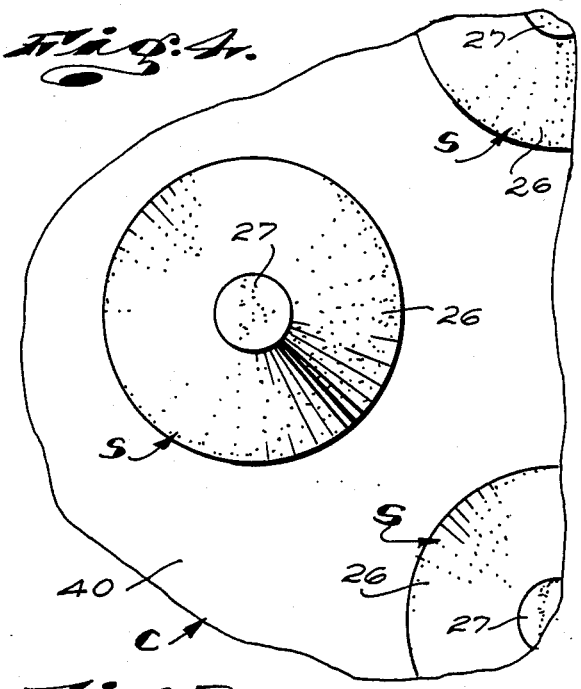
FIG. 4 is a view taken as indicated by Line 4—4 on FIG. 2.

Referring to Fig. of the drawings, I have shown a waterbed structure A embodying my invention.

The waterbed structure A includes a frame F with a waterfilled watermattress M related to it and in which my new interior support structure and wave motion dampening structure I is positioned.

The frame F is, for example, a fabricated wood structure including a flat horizontal mattress-supporting platform 10, vertical longitudinally extending side retaining boards 11 and vertical laterally extending end boards 12 that are coextensive with and project upwardly from related edges of the platform 10 and define an upper horizontal rim 14 about the perimeter of the frame.

The watermattress M is a simple bladder of soft, flexible sheet plastic that is engaged within the frame F and is filled with water. The watermattress has a horizontal bottom wall 20 that is engaged atop and supported by the platform 10, vertical side and end walls 21 and 22 in flat opposing and retained engagement with the inside surfaces of the boards 11 and 12 and a normally substantially flat horizontal top wall 23 that occurs on a plane that can be said to be substantially coplanar with the plane of the rim 14 of the frame F.

The watermattress M is, as noted above, filled with water or an equivalent medium so as to displace as much air from within the watermattress as is possible and so that the top is sufficiently slack to enable downward displacement of that wall and a volume of water beneath it that is likely to be displaced by the weight of persons that are likely to be supported on the top wall in the normal anticipated use of the watermattress.

In practice, the frame and watermattress can be provided in many different sizes. For the purpose of this disclosure and for example, the frame and mattress will be said and/or considered to be more than 7′ long, more than 4′ wide and will be described as being 8″ deep.

Further, in practice, a sheet plastic liner (not shown) is normally engaged in the frame to occur between the water mattress and its related surfaces of the frame. Still further, a blanket-type resistance heater structure (not shown) is often arranged between the platform and the bottom wall of the watermattress to heat the water therein for creature comfort. Still further, the watermattress, which is ordinarily fabricated of cut and welded pieces of sheet plastic, is provided with a fluid or water-conducting fitting (not shown) to enable filling and emptying the watermattress of water, as circumstances require. Since the several above-noted details in no way touch upon or affect the novelty of my invention, I have elected not to illustrate them and will not unnecessarily burden this disclosure with further detailed description thereof.

The interior support and wave motion dampening structure I that I provide is characterized by a multiplicity of elongate, vertically extending laterally and longitudinally spaced-apart resilent support spring parts S. While the support spring parts S are not resilent metal parts, such as coil spring, that the term "spring" normally suggests, they are nonetheless resilent devices that return to their original shape after being forced out of shape and are therefore properly called "springs." The parts S are also support parts, accordingly, for the purpose of this disclosure and in claiming my invention the parts S will hereinafter be referred to as support support spring parts.

The support spring parts are elongate, vertically extending downwardly convergent conical parts with large diameter, flat, upwardly disposed top surfaces 25, cylindrical outside surfaces 26 and lower tip ends 27. Due to manufacturing procedures and the like, the lower tip ends 27 are not sharply pointed but are truncated or otherwise formed to present substantially downwardly disposed lower end surfaces of minor diammetric extent and such that they can properly be defined as "ends."

The support spring parts S are shaped spring parts, that is, they function to afford ever-increasing or exponentially greater force as they are compressed axially. It is preferred that they are shaped so that when compression thereof is first initiated they are rather weak and afford little resistance or supporting strength; are such that when they are compressed an extent equal to about one-quarter their length they afford notable resistance and supporting strength; and, are such that when compressed a distance equal to one-half their length they afford substantial resistance to further compression and afford substantial supporting strength. In practice, where great forces are concentrated on small areas of the structure here provided, the parts S might be compressed to less than one-eighth their normal axial extent.

In furtherance of the above, the support spring parts S can be substantially equal in vertical or axial extent to the normal depth of the watermattress so that they extend in between and are in supporting engagement with and between the top and bottom walls 20 and 23 thereof. In the example given, where the mattress is 8″ deep, the parts S are 8″ in length or vertical extent.

In the preferred carrying out of the invention, upper and lower panels or sheets U and L are provided to occur adjacent the lower surface of the top wall and adjacent the top surface of the bottom wall of the watermattress. The function of the sheets U and L will hereinafter be described. The depth of the sheets U and L is, for example, ¾″. Accordingly, the support spring parts S, when such sheets are provided, need only be 6-½″ in vertical extent.

The support spring parts S are made of readily compressible, soft, water-permeable, resilient, interconnected cellular foam plastic material and are such that the cells thereof are normally fully occupied or filled with the water that fills the watermattress. The water in the cells of the parts S normally supports the walls of the cells and serves to urge and hold the whole of the parts in their normal configuration. Upon compression of the parts S axially, their smaller in diameter, weaker and less massive lower end portions are the first to be compressed portions and, in a progressive manner, each upper portion of greater effective cross-section and mass is compressed and is, in effect, moved up and into engagement in its next-adjacent upper portion as compression of the parts progresses. As the parts S are compressed, the water in the cells thereof is expressed therefrom. The resistance to the flow of water afforded by the cellular structure of the material of which the parts S are made dampens and slows the rate at which the parts compress. As axially compression of the parts S continues and as the diameter and mass or effective cross-section of those parts which compress increases, the volume of water, the number of cells through which it must flow and the distance it must flow while being expressed from the parts increases at a notable rate and in such a manner that the dampening effect increases at a correspondingly rapid rate, progressively slowing the rate at which the parts compress.

As a result of the above, the supporting effect afforded by the parts S is initially so little or minor that when a person engages his or her body atop the top wall of the watermattresses, so as to cause that wall to be depressed and so that the parts S therebelow are compressed, the support and resistance afforded by the parts S is, at first, substantially undetectable. As compression of the parts S is increased, their rate of compression is progressively slowed in such a manner that the person or persons atop the watermattress only sense that his or her "dropping" or "plunging" downwardly into the watermattress structure is being noticeably progressively slowed. In this regard, it is to be noted that the above-sense of being slowed is readily perceived by a person who is familiar with the action that is afforded by ordinary unenhanced watermattresses or by comparative use of such a common watermattress and a watermattress embodying my invention.

It will be readily apparent that when the support spring parts S are unloaded and let to return to their original and normal shape, they draw water back into and through their many cells. The water thus drawn back into the parts S serves to dampen and slow the spring rate of the parts S. The dampening action of the water as it moves back into the parts S is such that is substantially eliminates any rebound action that might otherwise be perceived and found to be objectionable.

At this time, it is believe appropriate to describe the nature and function of the lower sheet or panel L that is interposed between the bottom wall and lower ends of the parts S;. When the support spring parts S are compressed downwardly toward the bottom wall of the watermattress, the bottom wall works to seal off or close those outwardly opening cells of the parts that it opposes, preventing water from being expressed therethrough and depriving the parts of a full and adequate supply of water, when the parts are unloaded and allowed to expand. The foregoing noticeably and adversely slows the rate at which the parts can resume their normal shape. Accordingly, it has been found highly desirable and, in some instances, necessary that the bottom wall of the watermattress not be permitted to interfere with the flow of water into and out of the parts 10. To this end, the lower sheet L is provided. The lower sheet L is a flat horizontal sheet of waterpermeable sheet material. The sheet L can be made of reticulated plastic, garnetted fibers or any other highly porous material and is such that is provides for substantial free conducting of water between the bottom wall of the watermattress and those surfaces of the parts S that, in the course of using the invention, are moved into engagement therewith. Thus, the flow of water out of and into the parts S is not adversely affected by the bottom wall of the watermattress.

In addition to the above-noted primary function of the lower sheet L, the lower sheet L also provides a highly irregular and/or porous top surface that tends to engage and mechanically lock and/or grip with the irregular open cellular surface of the support parts that contact it and thereby serves to normally maintain the parts 10 vertically disposed and in desired spaced relationship from each other.

The upper sheet or panel U referred to above and as shown in the drawings in a thin waterpermeable sheet of interconnected cellular foam plastic or the like with an undulating, serpentine or waffle-like textured top surface that opposes the bottom surface of the top wall of the watermattress and that causes the top wall, when slacked, to assume a corresponding textured surface. The purpose of the foregoing is to eliminate excess slack in the top wall of the watermattress and thereby prevent the top wall from establishing creases and folds that might be unsightly and/or discomforting. The sheet U is made of waterpermeable open cellular or fibrous material that does not adversely interfere with the movement of water in and through the watermattress. For example, it allows heated water in the watermattress below it to move upwardly through it and into heat conducting contact with the top wall of the watermattress.

In my invention, the sheet U is supported and held up in the mattress by the support spring parts S and need not be made buoyant or require the provision of other and special flotation means to keep and maintain it up in its working position.

Figure 5:
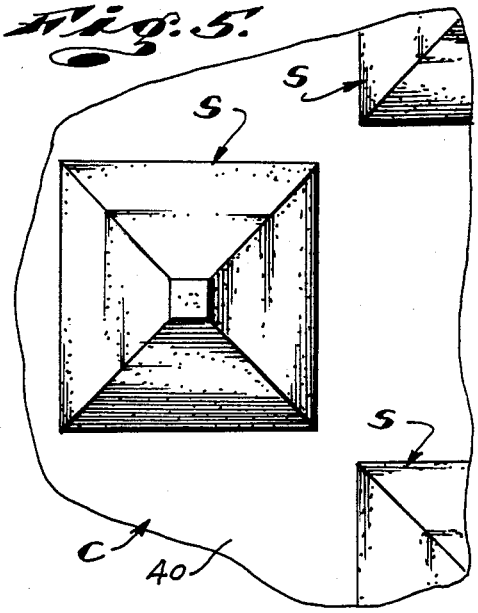
FIG. 5 is a view similar to FIG. 4 showing a modified form of the invention.

While I have described the support springs S as being conical, it will be apparent that the cross-sectional configuration of those parts can be any suitable and desired polygonal cross-section. For example and as shown in FIG. 5 of the drawings, the parts S can be square in cross-section and pyramidal in form.

In the case illustrated and in the preferred carrying out of my invention, the upper ends of the parts S are joined or tied together by suitable connecting means C that serve to maintain those ends of the parts S properly oriented and in predetermined spaced relationship one from the other. The means C can be in the form of plastic filaments, plastic ribbons, perforated or cellular sheet material, or the like, to which the parts are suitably mechanically attached. However, in the preferred carrying out of the invention and as shown, the means C is a thin top carrier sheet 40 established of the same waterpermeable, flexible resilient interconnected cellular form plastic of which the parts S are made. The sheet 40 extends between the parts 40 and are integrally joined therewith about the perimeters of the upper end portions thereof. In practice, the sheet 40 is approximately ½" thick but, depending upon the size and spacing of the parts and the stiffness and structural integrity of the plastic of which the sheet is made, it can be increased or decreased in thickness as circumstances require.

Figure 6:
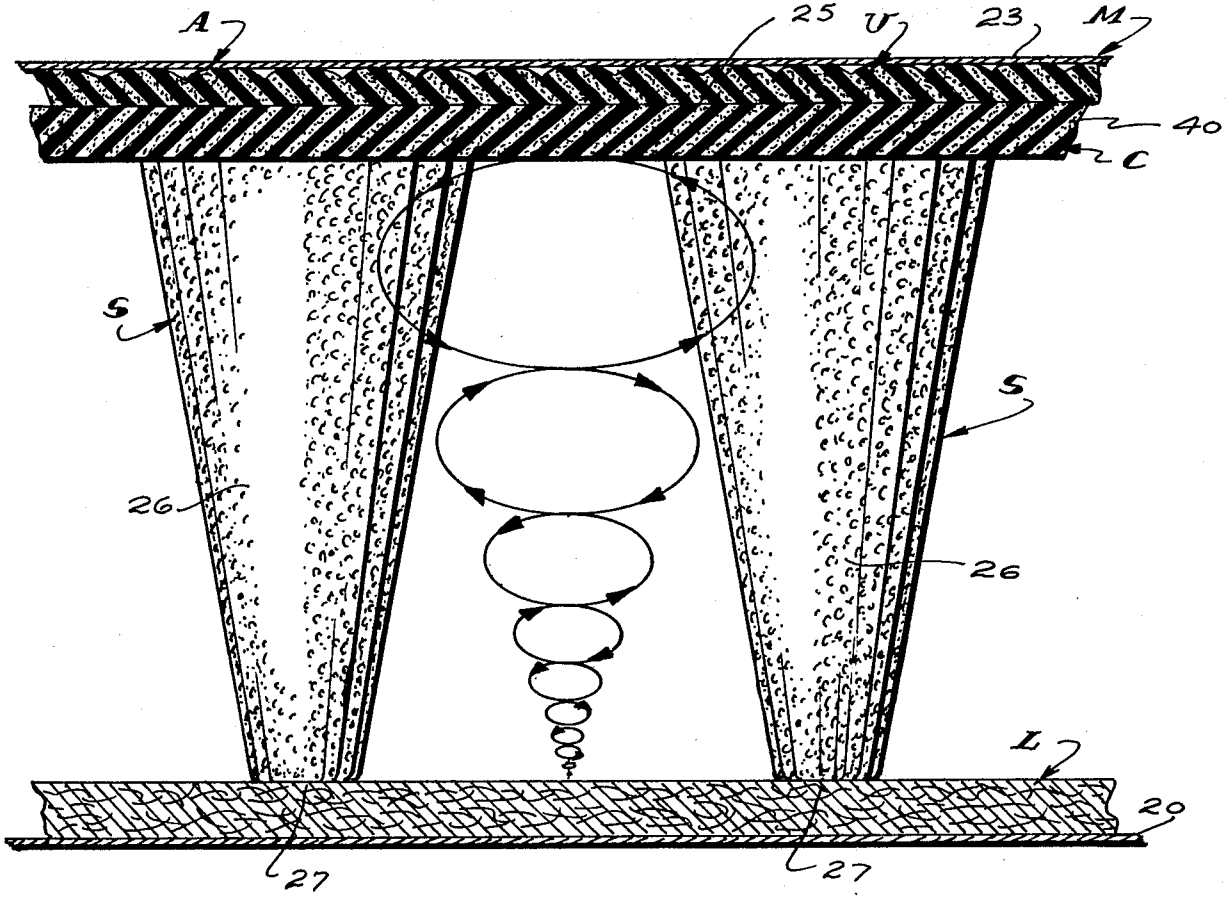
FIG. 6 is a diagrammatic view showing the diminishing orbital movement of water molecules and wave motion energy relative to a pair of support spring parts.

The highly unique and special feature of my invention is its wave motion dampening capabilities. In FIG. 6 of the drawings, I have diagrammatically illustrated certain characteristics of wave motion and wave motion energy in relationship to my new waterbed structure. The several ellipses in FIG. 6 represent the magnitude of wave motion and wave energy. The shape of the ellipses represent the orbital paths in which water molecules, in waves, move. Greater wave motion and energy occur at the surface (top) of the water, below the top wall of the watermattress. Wave motion and energy diminishes downwardly as it extends downwardly in the water and is extinguished or nulled by the time it reaches the bottom. The energy of waves moves horizontally in the direction in which the waves move and is progressively transferred, horizontally, between adjacent water molecules. If waves are unimpeded and are caused to be impinge upon hard, nonyielding surfaces, they are simply reflected or deflected thereby and rebound or continue to move in another direction.

In the case at hand, as diagrammatically illustrated in FIG. 6 of the drawings, wave motion and wave motion energy is greatest at the top of the water within the watermattress, below the top wall thereof and diminishes downwardly and is extinguishes at the bottom wall of the watermattress. Accordingly, if means are to be provided to absorb the energy of waves in the watermattress, the upper portion of that means, in the upper portion of the watermattress, will be required to receive and absorb the greater part of the energy and to perform the greater part of the work required to be performed. The lower portion of that means, in the lower portion of the watermattress, will be required to absorb little energy and perform a negligible or small amount of the work to be performed.

In furtherance of the foregoing, where wave motion dampening and wave motion energy absorbing means are provided in watermattresses, those means must be made to create as little resistance to the displacement, flow and/or movement of water from one portion of the mattresses to another so that the basic action and function of the watermattresses is not adversely interferred with or affected.

The greater number of those means provided by the prior art to dampen wave motion in watermattresses, function to adversely interfere with the displacement, transfer and/or movement of water in the watermattresses and in some way or manner adversely affect the utility of the watermattresses.

In my invention, the open cellular surfaces of the soft, resilient interconnected cellular support spring parts S and the upper carrier sheet 40 related thereto effectively receive or capture substantially all of the energy of waves that impinge upon them and disburse and spread that energy within the parts S and 40. The diammetric extent and surface area of the upper portion of the parts S that occur within the upper portion of the watermattress where the greatest wave motion is encountered and the greatest wave motion energy is encountered is great or substantial while the diameter, size and surface area of the lower portions of the parts S that occur within the lower portions of the watermattress, where little or no appreciable wave action and/or energy is encountered, is slight or little. Further, the lower portions of the parts S afford little resistance and/or interference to the displacement and movement of water throughout the lower portion of the watermattress. Accordingly, the wave motion dampening and wave energy absorbing function and/or capability of the structure I that I provide is greatest within the upper portion of the watermattress where needed and is negligible in the lower portion of the watermattress where it is not needed.

In practice, the angle of downward convergence of the parts S is preferably made to be slightly greater than the downward angle at which the wave motion and wave energy of the dominant size of waves likely to be encountered during normal anticipated use of the watermattress diminish. Accordingly, the number, size, shape and placement of the parts S can be made so that all wave motion, normally encountered in the watermattress, is substantially completely dampened within a nearly imperceptible period of time.

In accordance with the above, it will be apparent that the structure I of the present invention effectively works to dampen wave motion in the watermattress while it in no way works to adversely affect the movement or transfer of water therein, from one area thereof to another.

It has been determined that in practice, the support spring parts S need not be arranged throughout the entire plane of the watermattress to obtain desired and effective wave motion dampening effect. It has been found that strips or bands of the parts S, each including three or four rows of the parts, in staggered relationship to each other, and arranged to occur along one side and one end of the watermattress affords great and superior wave motion dampening effect than many of those distinct forms of wave motion dampening means that are provided by the prior art.

Referring once again to the supporting function of the parts S, it has been determined that when a number of those parts are positioned beneath a side edge portion upon which a person sits when moving onto or from engagement upon the frame supported and retain watermattress, those parts worked upon, collectively, afford sufficient vertical support so that the top wall of the mattress is depressed downwardly a small portion of the distance that an ordinary, unenhanced watermattress is depressed under like circumstances. For example, in an 8" deep watermattress embodying the present invention the top wall might be depressed but 2" or 3" while in an 8" deep unenhanced watermattress the top wall is likely to be depressed from 5" to 7". If the edge of the watermattress is depressed but 2" to 3" under such circumstances, the person can still easily and conveniently swing or move his or her legs over the adjacent retaining board of the frame. On the other hand, when the edge of a watermattress is depressed 5" to 7", under such circumstances, the user is "sunk" into the mattress to such an extent that he or she must struggle to extract himself or herself therefrom, for any purposes or reason.

In furtherance of the above, when a person is seated on the side of my new watermattress structure with his or her legs over and supported by the adjacent retaining board of the frame F, the load applied to the parts S worked upon is notably reduced and the extent to which the affected side portion of the watermattress is depressed is reduced to a negligible amount of, for example, 1" or 2".

In furtherance of my invention, the watermattress is provided with a plurality of laterally and longitudinally spaced part S throughout that central portion of the watermattress atop which the lower lumbar regions of the backs of users of the watermattress are normally positioned and that serve to impart that portion of the mattress with greater or increased vertical support and that serves to hold the noted lower back portions of the users up and in a position relative to the remainder of their bodies where their backs are supported sufficiently straight to assure the best possible rest. That is, so that the noted lower lumbar regions of their backs are not permitted to sink within the watermattress to an extent that the whole of their backs are so bent and/or distorted as to adversely stress their backs and cause fatigue and/or discomfort.

In carrying out my invention, to; conserve of materials; reduce costs; reduce packaging and shipping space; reduce weight; and to attain other desirable ends, the support spring parts are only provided for and arranged within those portions of the watermattress where added support is desired and/or where they must be provided to attain desired and effective wave motion dampening results.

In accordance with the above, in FIGS. 7 through 10 of the drawings I have diagrammatically shown four different arrangements of support parts S that have been reduced to practice, tested and found to provide satisfactory end results.

Figure 7:
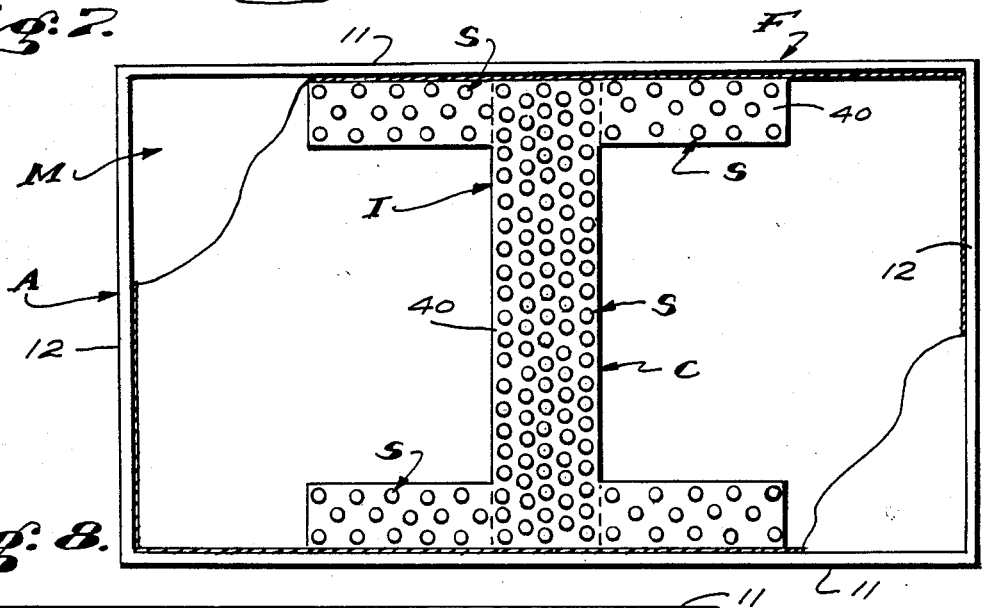
FIG. 7 is a diagrammatic plan view of one embodiment of the invention.

In FIG. 7 of the drawings, an "H"-shaped pattern of part S is shown. With this pattern of parts S the structure I affords desired supplemental vertical support along the opposite side edge portions of the watermattress upon which the users are likely to sit and across the center portion of the watermattress atop which the lower lumbar regions of users' backs are normally engaged and/or supported. In this embodiment of the invention, the longitudinally extending and laterally extending groups or series of parts S are carried by ribbon or strip-like portions of the sheet 40. The several definable portions of this "H"-shaped structure are effective to maintain the structure in desired position within the watermattress.

Figure 8:
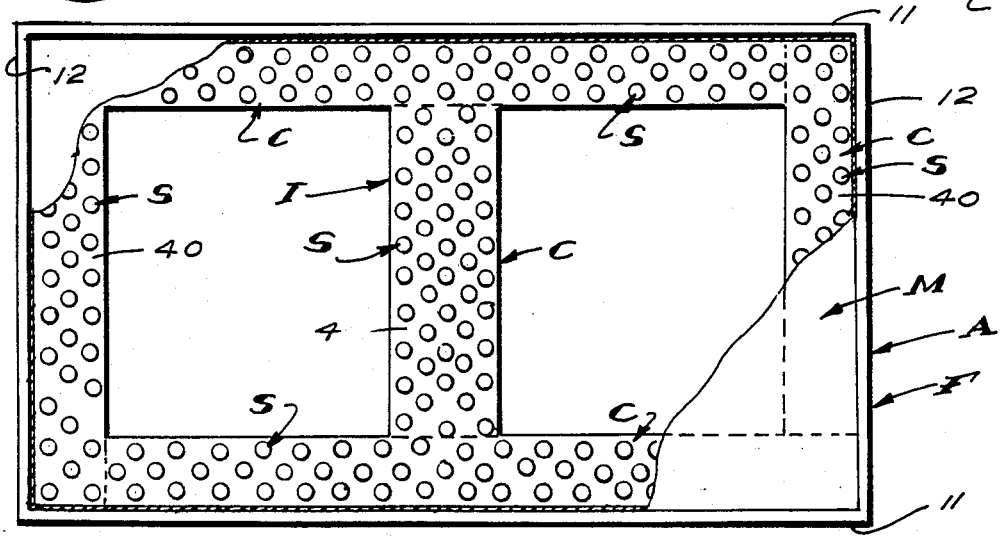
FIGS. 8, 9 and 10 are diagrammatic views showing other embodiments of my invention; and, FIG. 11 is an isometric view of another form of the invention.

In FIG. 8 of the drawings, yet another pattern of parts S that has provided to be highly effective is illustrated.

Figure 9:
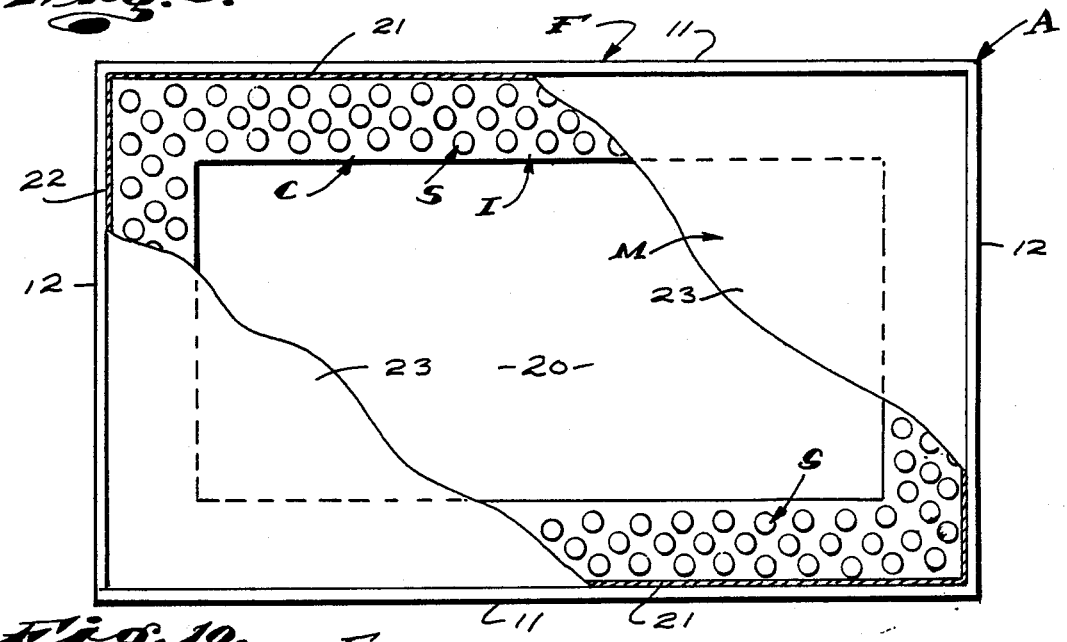

In FIG. 9 of the drawings, I provide a rectangular pattern and/or series of parts S about the inner perimeter of the watermattress.

Figure 10:
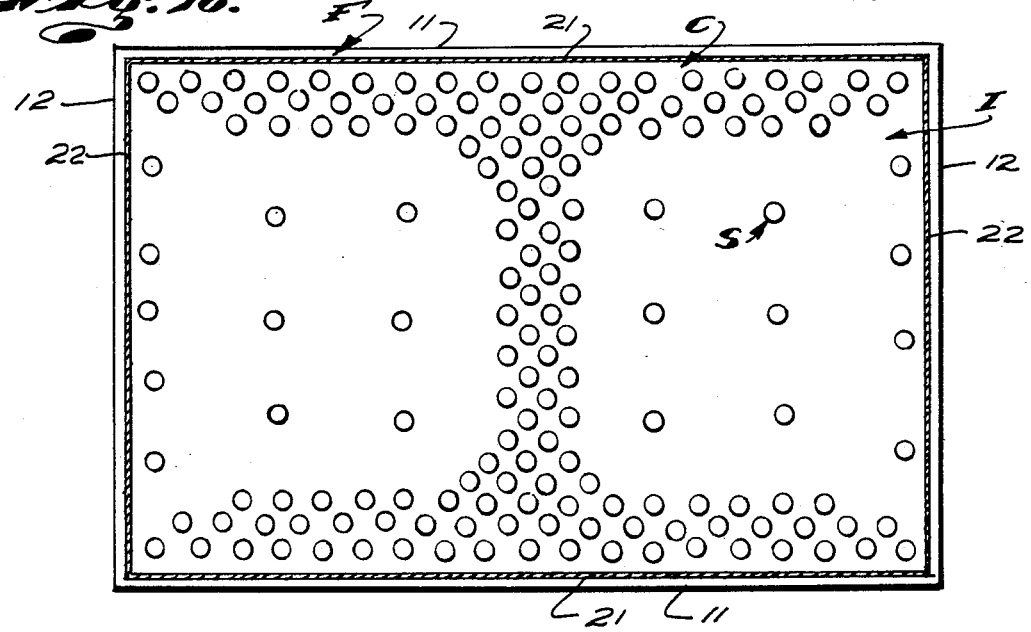

In FIG. 10 of the drawings, a similar "H"-shaped pattern of parts S is shown formed on a single carrier sheet that is coextensive with the top wall of the watermattress and which has a number of secondary parts S within the open spaces defined by the "H" pattern of parts S and that are provided to hold their related portions of the sheet up and in working position.

Figure 11:
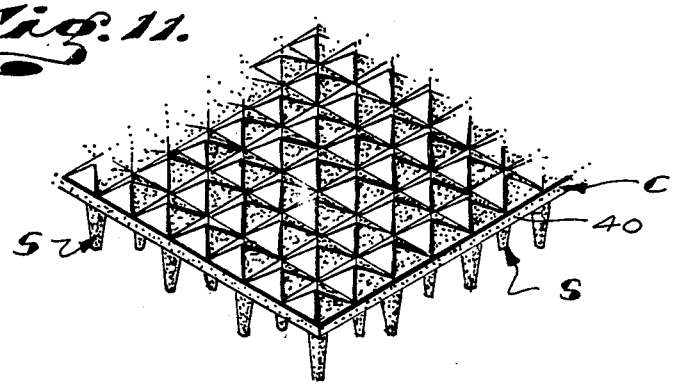

Finally, in FIG. 11 of the drawings, I have illustrated a modified form of my invention wherein the top surface of the carrier sheet 40 is formed with a textured pattern consisting of a multiplicity of peaks and valleys that serve to effectively support the top wall of the watermattress when it is slack and to eliminate the need for and/or use of those separate textured sheets or panels now commonly used throughout the art to perform the same or similar function.

Having described typical preferred forms and embodiments of my invention, I do not wish to be limited to the specific details herein set forth but wish to reserve to myself any modifications and/or variations that might appear to those skilled in the art and which fall within the scope of the following claims.

1. A waterbed structure with vertical, longitudinal and lateral axes and including a waterfilled watermattress made of flexible sheet plastic material and defining a flat horizontal bottom wall, a normally substantially flat horizontal top wall in vertical spaced relationship above the bottom wall, laterally spaced vertical longitudinally extending side walls and longitudinally spaced laterally extending vertical end walls, a frame structure below and about the perimeter of the mattress supporting the bottom wall and including side and end boards retaining the side and end walls, said watermattress including a multiplicity of laterally and longitudinaly spaced elongate vertically extending axially compressible support spring parts in reactive relationship with and between the top and bottom walls and normally reacting between those walls to yieldingly support the top wall up and in predetermined normal spaced relationship above the bottom wall, the support spring parts being downwardly convergent shaped spring parts made of soft resilient water permeable. Interconnected cellular material, each part functioning to exert exponentially greater vertical load supporting force on the top wall upon progressive downward displacement of the portion of the top wall above it and corresponding axial compression of said part.

2. The waterbed structure set forth in claim 1 wherein water within the mattress permeates the support spring parts and is expressed from within and is drawn into the support spring parts as they are forcibly compressed and are left to return to their normal shape, water moved in to and out of said support spring parts dampening the rate of movement of those parts.

3. The waterbed structure set forth in claim 1 wherein the support spring parts are arranged and disposed within the watermattress to allow for the horizontal movement of water therein and to absorb and spend wave motion energy therein.

4. The waterbed structure set forth in claim 1 wherein the upper portions of the support spring parts are greater in owes section and volumetric extent and present greater surface area than related lower portions thereof and wherein the upper portions of said parts occupy a greater volume of the space within the upper portion of the watermattress where wave motion is greater and stronger than within the lower portion of the watermattress wherein wave motion is the least and weakest, the upper portions of said parts affording great resistance to horizontal movement of water and having greater wave motion energy absorbing capacity than the lower portions thereof.

5. The watermattress structure set forth in claim 1 that further includes a lower sheet of waterpermeable material interposed between the bottom wall and lower ends of the support spring parts in load conducting engagement therewith and upon and across which said parts are forcibly engaged when said parts are compressed axially and that substantially freely conducts water in to and out of said parts at the surfaces thereof that oppose said lower sheet.

6. The watermattress structure set forth in claim 1 that further includes flexible connecting means joined with and extending between the upper end portions of the support spring parts and that orient and normally maintain said parts in predetermined spaced relationship with each other and properly oriented within the watermattress.

7. The watermattress structure set forth in claim 1 that further includes flexible connecting means joined with and extending between the upper end portions of the support spring parts and that orient and normally maintain said parts in predetermined spaced relationship with each other and properly oriented within the watermattress, said connecting means including a top sheet of thin flexible waterpermeable interconnected cellular material extending between and joined with the upper end portions of said parts about the perimeters thereof.

8. The watermattress structure set forth in claim 1 that further includes flexible connecting means joined with and extending between the upper end portions of the support spring parts and that orient and normally maintain said parts in predetermined spaced relationship with each other and properly oriented within the watermattress, said connecting means including a top sheet of thin flexible water permeable interconnected cellular material with portions that extend between and connect with related portion of adjacent parts, the top sheet having a texture top surface with spaced apart upper and lower portions opposing the top wall and with which the top wall normally substantially conforms.

9. The waterbed structure set forth in claim 1 wherein the support spring parts are arranged and occur below that portion of the top wall upon which the lower lumbar region of a user's back is normally supported and work to supplement the vertical load supporting capacity of their related portions of the top wall to prevent excessive downward displacement thereof and excessive bending of the user's back.

10. The watermattress structure set forth in claim 1 wherein the support spring parts are arranged and occur below at least one side portion of the watermattress upon which a user sits when moving on to and off of engagement atop the top wall of the watermattress and in close proximity to a related retaining board, the parts working to prevent excessive downward displacement of said portion of the top wall and to support the use up for easy movement relative thereto and relative to the retaining board.

11. The waterbed structure set forth in claim 1 wherein the support spring parts are arranged below those portions of the top wall upon which the lower lumbar region of the back of a user lying upon the top wall is supported and below at least one perimeter portion of the the top wall in close proximity to a related retaining board and upon and about which a user sits and moves when moving on to and from engagement atop the watermattress and so that said parts work to yieldingly impart supplemental vertical support into said central and perimeter portions of the top wall and prevent excessive adverse downward displacement thereof.

12. The watermattress structure set forth in claim 1 wherein rows of laterally and longitudinally spaced support spring parts are positioned within the watermattress to extend longitudinally of the side walls and below those side portions of the top wall that are adjacent to said side walls and upon which users of the bed sit and that extend transversely below that central portion of the top wall upon which the lower lumbar region of the backs of users lying atop the top wall are supported.

13. The waterbed structure set forth in claim 1 wherein the space between adjacent spring parts is reduced and the number of spring parts is increased below those portions of the top wall where the vertical loads imposed upon the top wall during normal anticipated use of the watermattress are greatest.

14. In combination, a water-filled bladder-like watermattress with a stationary horizontal bottom wall and a flexible downwardly displaceable horizontal top wall that is normally in predetermined spaced relationship above the bottom wall; and, a plurality of elongate vertically extending support spring parts of soft resilient water permeable interconnected cellular foam material in horizontal spaced relationship one from the other and in vertical load transmitting relationship with and between the top and bottom walls and reacting therebetween to normally yieldingly urge and hold the top wall in its normal position and to yieldingly resist downward displacement thereof, the spring parts being spaced to allow for substantially free horizontal displacement of water and to intercept, absorb and spend wave motion energy conducted through the water.

15. The combination set forth in claim 14 wherein the support spring parts are downwardly convergent shaped spring parts the vertical load supporting force of which exponentially increases as they are compressed axially.

16. The combination set forth in claim 14 wherein the support spring parts are downwardly tapered shaped spring parts the effective cross sections of which progressively diminishes downwardly and the vertical load supporting force of which exponentially increases as they are compressed axially, the spring rate of the support springs being slowed by the resistance to the flow of water afforded by the foam plastic material of which they are made.

* * * * *